US007982132B2

(12) United States Patent
Hopkinson et al.

(10) Patent No.: US 7,982,132 B2
(45) Date of Patent: Jul. 19, 2011

(54) REDUCED SIZE IN TWISTED PAIR CABLING

(75) Inventors: Wayne C. Hopkinson, Hickory, NC (US); Trent M. Hayes, Hickory, NC (US); David A. Wiebelhaus, Hickory, NC (US); Daniel J. Parke, Hickory, NC (US)

(73) Assignee: CommScope, Inc. of North Carolina, Hickory, NC (US)

( * ) Notice: Subject to any disclaimer, the term of this patent is extended or adjusted under 35 U.S.C. 154(b) by 106 days.

(21) Appl. No.: 12/406,769

(22) Filed: Mar. 18, 2009

(65) Prior Publication Data

US 2009/0236121 A1 Sep. 24, 2009

Related U.S. Application Data

(60) Provisional application No. 61/037,904, filed on Mar. 19, 2008.

(51) Int. Cl.
*H01B 7/00* (2006.01)

(52) U.S. Cl. ..... 174/113 R; 174/110 R

(58) Field of Classification Search ..... 174/113 R, 174/110 R

See application file for complete search history.

(56) References Cited

U.S. PATENT DOCUMENTS

| | | | | |
|---|---|---|---|---|
| 3,364,305 | A | 1/1968 | Hanlon et al. | |
| 3,584,132 | A * | 6/1971 | Brauns et al. | 174/34 |
| 5,283,390 | A | 2/1994 | Hubis et al. | |
| 5,796,046 | A | 8/1998 | Newmoyer et al. | |
| 6,272,828 | B1 * | 8/2001 | Walling et al. | 57/58.49 |
| 6,787,694 | B1 * | 9/2004 | Vexler et al. | 174/27 |
| 6,875,928 | B1 | 4/2005 | Hayes et al. | |
| 2005/0006132 | A1 | 1/2005 | Clark | |
| 2005/0133246 | A1 | 6/2005 | Parke et al. | |
| 2005/0167146 | A1 | 8/2005 | Wiekhorst et al. | |
| 2006/0207786 | A1 * | 9/2006 | Clark | 174/110 R |
| 2007/0044996 | A1 * | 3/2007 | Clark | 174/113 R |
| 2008/0073106 | A1 | 3/2008 | Brake et al. | |

* cited by examiner

*Primary Examiner* — Chau N Nguyen

(74) *Attorney, Agent, or Firm* — Muncy, Geissler, Olds & Lowe, PLLC

(57) ABSTRACT

A twisted pair cable and a method of making the twisted pair cable are described. First and second insulated conductors are twisted about each other to form a twisted pair. A first insulating material surrounds a first conductor to form the first insulated conductor. In a first alternative or supplemental embodiment, the first insulating material directly abuts a circumference of the first conductor and has a first area with a first radial thickness and a second area with a thinner radial thickness. In a second alternative or supplemental embodiment, the first insulating material has a first area with a first radial thickness and a second area with a thinner radial thickness and the first area resides along a portion of the first insulated conductor which is abutting the second insulated conductor.

20 Claims, 9 Drawing Sheets

REDUCED SIZE IN TWISTED PAIR CABLING

This application claims the benefit of U.S. Provisional Application No. 61/037,904, filed Mar. 19, 2008, the entire contents of which are herein incorporated by reference.

BACKGROUND OF THE INVENTION

1. Field of the Invention

The present invention relates to a twisted pair cable for communication of high speed signals, such as a local area network (LAN) cable. More particularly, the present invention relates to a twisted pair cable having an asymmetrical insulation layer on one or more insulated conductors of a twisted pair of the LAN cable.

2. Description of the Related Art

FIG. 1 shows a cable 1 with a jacket 7, in accordance with the background art. The cable 1 has a first twisted pair 11, a second twisted pair 13, a third twisted pair 15, and a fourth twisted pair 17. Each twisted pair includes two conductors. Specifically, the first twisted pair 11 includes a first insulated conductor 19 and a second insulated conductor 21. The second twisted pair 13 includes a third insulated conductor 23 and a fourth insulated conductor 25. The third twisted pair 15 includes a fifth insulated conductor 27 and a sixth insulated conductor 29. The fourth twisted pair 17 includes a seventh insulated conductor 31 and an eighth insulated conductor 33.

Each of the first through eighth insulated conductors 19, 21, 23, 25, 27, 29, 31 and 33 is constructed of an insulation layer surrounding an inner conductor, as best exemplified in the cross sectional view of FIG. 3. The outer insulation layer may be formed of a flexible plastic material having flame retardant and smoke suppressing properties. The inner conductor may be formed of a metal, such as copper, aluminum, or alloys thereof.

As illustrated in FIG. 1, each twisted pair 11, 13, 15 and 17 is formed by having its two insulated conductors continuously twisted around each other. For the first twisted pair 11, the first insulated conductor 19 and the second insulated conductor 21 twist completely about each other, three hundred sixty degrees, at a first interval w along the length of the cable 1. The first interval w may purposefully vary within a first range of values (randomly or in accordance with an algorithm) along the length of the cable 1.

For the second twisted pair 13, the third insulated conductor 23 and the fourth insulated conductor 25 twist completely about each other, three hundred sixty degrees, at a second interval x along the length of the cable 1. The second interval x may purposefully vary within a second range of values (randomly or in accordance with an algorithm) along the length of the cable 1.

For the third twisted pair 15, the fifth insulated conductor 27 and the sixth insulated conductor 29 twist completely about each other, three hundred sixty degrees, at a third interval y along the length of the cable 1. The third interval y may purposefully vary within a third range of values (randomly or in accordance with an algorithm) along the length of the cable 1.

For the fourth twisted pair 17, the seventh insulated conductor 31 and the eighth insulated conductor 33 twist completely about each other, three hundred sixty degrees, at a fourth interval z along the length of the cable 1. The fourth interval z may purposefully vary within a fourth range of values (randomly or in accordance with an algorithm) along the length of the cable 1.

Each of the twisted pairs 11, 13, 15 and 17 has a respective first, second, third and fourth mean value within the respective first, second, third and fourth ranges of values. Each of the first, second, third and fourth mean values of the intervals of twist w, x, y and z may be unique, e.g., different from the other three values. More information about the cable 1 of the background art can be found in the Assignee's U.S. Pat. No. 6,875,928 and published U.S. Application 2008/0073106, which are incorporated herein by reference.

The first through fourth twisted pairs 11, 13, 15 and 17 may be separated by a star-shaped or plus-shaped separator 35 or separated from one another by a tape separator 35 or a multiplicity of tape separators 35 and may be wound together with the separator 35 in a direction 39 to form a twisted core. The core twist direction 39 may be in the same direction as the pair twist directions of the first through fourth twisted pairs 11, 13, 15 and 17.

FIG. 2 is a close-up view of the first twisted pair 11. FIG. 3 is a cross sectional view taken along line III-III in FIG. 2. FIGS. 2 and 3 illustrate that the first insulated conductor 19 would be formed by a first conductor 41 with a diameter D1 of about twenty-three gauge size, surrounded by a uniform layer of a first dielectric insulating material 43 having a radial thickness T1 of about eleven mils. Likewise, the second insulated conductor 21 would be formed by a second conductor 45 with a diameter D2 of about twenty-three gauge size, surrounded by a uniform layer of a second dielectric insulating material 47 having a radial thickness T2 of about eleven mils. Hence, the spacing S1 between the center of the first conductor 41 and the center of the second conductor 45 would be about 45 mils.

SUMMARY OF THE INVENTION

Although the cable of the background art performs well, Applicants have appreciated some drawbacks. Applicants have invented a twisted pair cable with new structural features, the object of which is to enhance one or more performance characteristics of a LAN cable, such as reducing insertion loss, matching impedance and balancing delay skew between twisted pairs, and/or to enhance one or more mechanical characteristics of a LAN cable, such as improving flexibility, reducing weight and/or size, or reducing smoke emitted in the event of a fire.

These and other objects are accomplished by a cable including a first conductor with a first insulating material surrounding the first conductor to form a first insulated conductor. The cable also includes a second conductor with a second insulating material surrounding the second conductor to form a second insulated conductor. The first and second insulated conductors are twisted about each other to form a twisted pair. In a first alternative or supplemental embodiment of the invention, the first insulating material directly abuts a circumference of the first conductor and has a first area with a first radial thickness and a second area with a second radial thickness, wherein the second radial thickness is less than the first radial thickness.

In a second alternative or supplemental embodiment of the invention, the first insulating material has a first area with a first radial thickness and a second area with a second radial thickness, wherein the second radial thickness is less than said first radial thickness, and the first area resides along a portion of the first insulated conductor which is abutting the second insulated conductor.

The cable of the present invention may be made by different methods, such as by extruding an asymmetrical insulation material over a conductor. However, in a preferred method, a typical twisted pair is guided through a work station and a portion of an insulation material is removed from at least one insulated conductor as the twisted pair passes through the workstation to form a shaved twisted pair.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus, are not limits of the present invention, and wherein.

DETAILED DESCRIPTION OF EMBODIMENTS OF THE INVENTION

Figure 1:
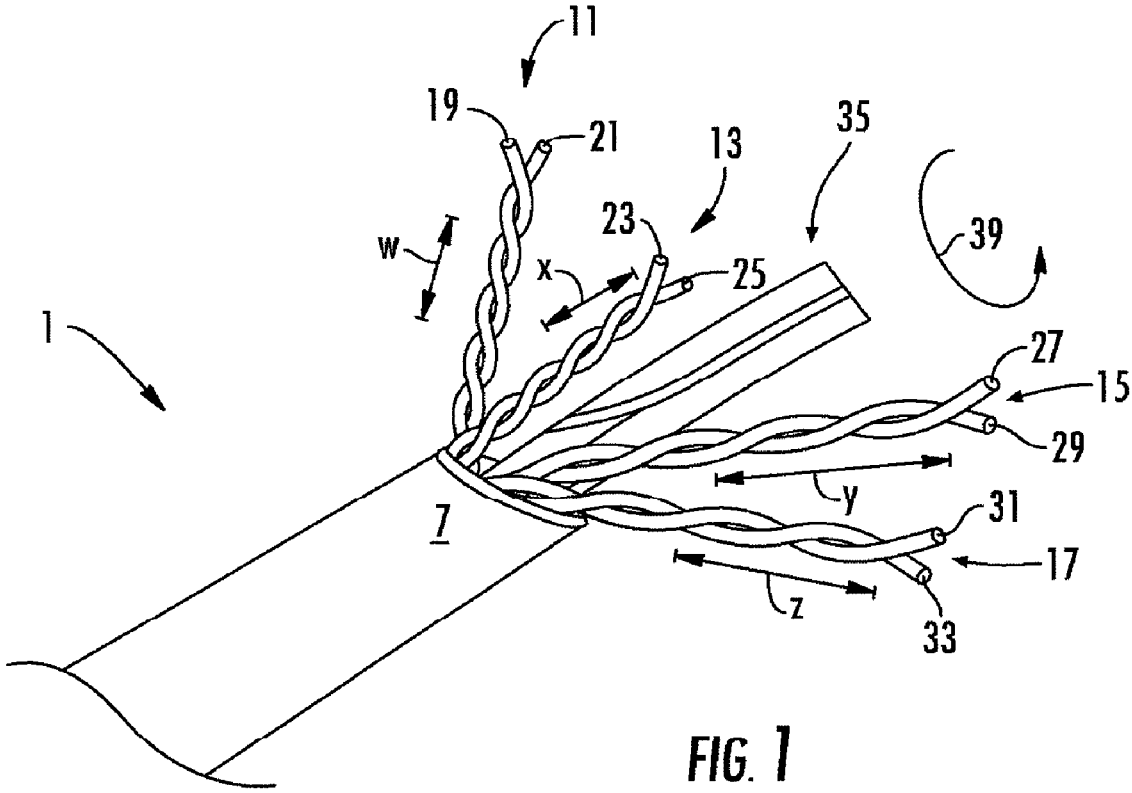
FIG. 1 (BACKGROUND ART)
FIG. 1 is a side view of a twisted pair cable, in accordance with the background art.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

Figure 4:
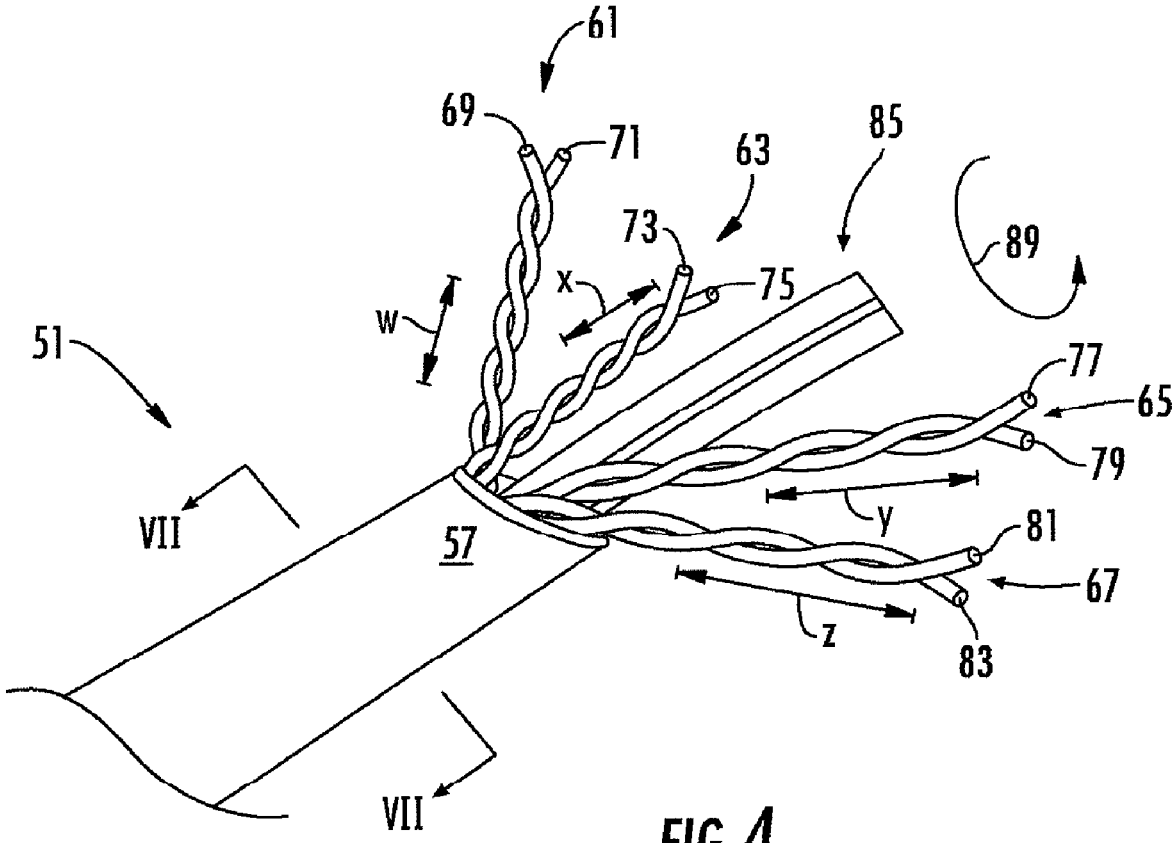
FIG. 4 is a side view of a twisted pair cable, in accordance with a first embodiment of the present invention.

FIG. 4 shows a cable 51 with a jacket 57, in accordance with a first embodiment of the present invention. The jacket 57 surrounds a first twisted pair 61, a second twisted pair 63, a third twisted pair 65, and a fourth twisted pair 67. The jacket 57 may be formed of polyvinylchloride (PVC), low smoke zero halogen PVC, polyethylene (PE), fluorinated ethylene propylene (FEP), polyvinylidene fluoride (PVDF), ethylene chlorotrifluoroethylene (ECTFE), or other foamed or solid materials common to the cabling art.

Each twisted pair 61, 63, 65 and 67 includes two insulated conductors. Specifically, the first twisted pair 61 includes a first insulated conductor 69 and a second insulated conductor 71. The second twisted pair 63 includes a third insulated conductor 73 and a fourth insulated conductor 75. The third twisted pair 65 includes a fifth insulated conductor 77 and a sixth insulated conductor 79. The fourth twisted pair 67 includes a seventh insulated conductor 81 and an eighth insulated conductor 83.

Figure 6:
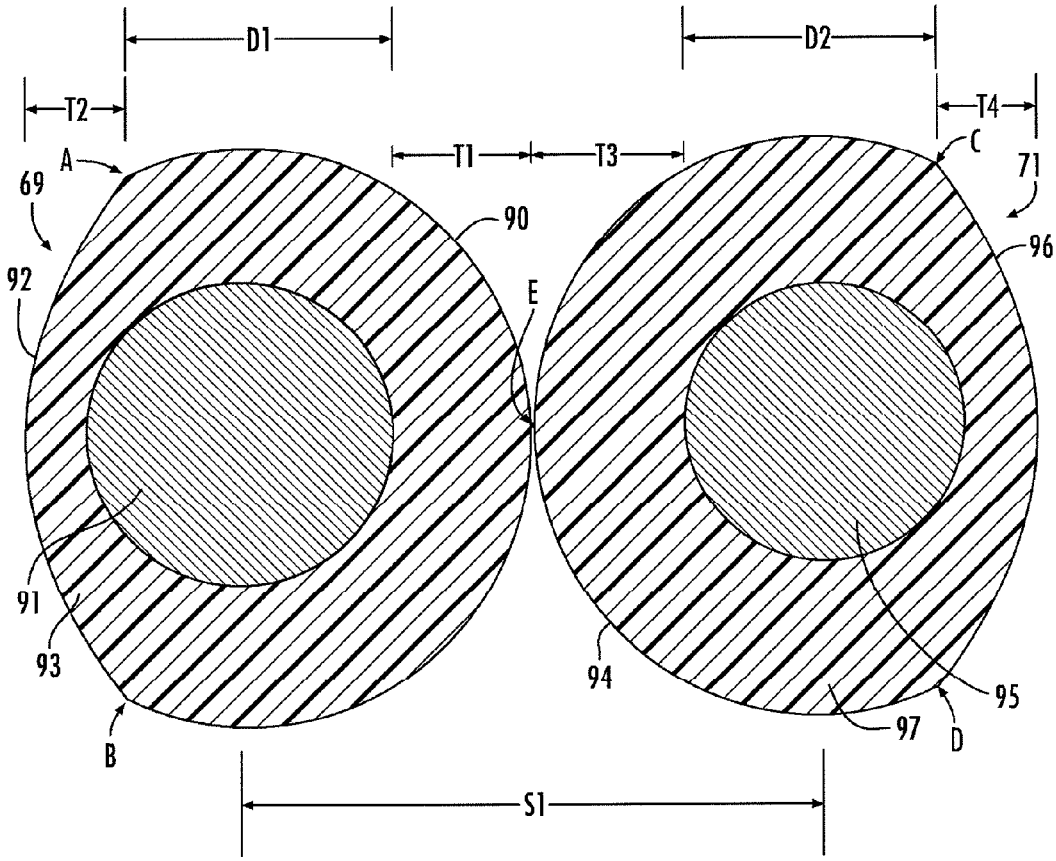
FIG. 6 is a cross sectional view taken along line VI-VI in FIG. 5.

Each of the first through eighth insulated conductors 69, 71, 73, 75, 77, 79, 81 and 83 is constructed of an insulation layer surrounding an inner conductor, as best exemplified in the cross sectional view of FIG. 6. The outer insulation layer may be formed of one or more of a flexible plastic material having flame retardant and smoke suppressing properties, such as a polymer or foamed polymer, common to the cabling art like fluorinated ethylene propylene (FEP), polyethylene (PE) or polypropylene (PP). The inner conductor may be solid or stranded, and may be formed of a conductive metal or alloy, such as copper. In one embodiment, the inner conductor is a solid, copper wire of about twenty three gauge size.

As illustrated in FIG. 4, each twisted pair 61, 63, 65 and 67 is formed by having its two insulated conductors continuously twisted around each other. For the first twisted pair 61, the first conductor 69 and the second conductor 71 twist completely about each other, three hundred sixty degrees, at a first interval w along the length of the cable 51. The first interval w may purposefully vary within a first range of values (randomly or in accordance with an algorithm) along the length of the cable 51.

For the second twisted pair 63, the third conductor 73 and the fourth conductor 75 twist completely about each other, three hundred sixty degrees, at a second interval x along the length of the cable 51. The second interval x may purposefully vary within a second range of values (randomly or in accordance with an algorithm) along the length of the cable 51.

For the third twisted pair 65, the fifth conductor 77 and the sixth conductor 79 twist completely about each other, three hundred sixty degrees, at a third interval y along the length of the cable 51. The third interval y may purposefully vary within a third range of values (randomly or in accordance with an algorithm) along the length of the cable 51.

For the fourth twisted pair 67, the seventh conductor 81 and the eighth conductor 83 twist completely about each other, three hundred sixty degrees, at a fourth interval z along the length of the cable 51. The fourth interval z may purposefully vary within a fourth range of values (randomly or in accordance with an algorithm) along the length of the cable 51.

Each of the twisted pairs 61, 63, 65 and 67 has a respective first, second, third and fourth mean value within the respective first, second, third and fourth ranges of values. Each of the first, second, third and fourth mean values of the intervals of twist w, x, y and z may be unique, e.g., different from the other three values. More information about the above-described twist modulation can be found in the Assignee's U.S. Pat. No. 6,875,928 and published U.S. Application 2008/0073106, which are incorporated herein by reference.

The first through fourth twisted pairs 61, 63, 65 and 67 may be separated from each other by a star-shaped or plus-shaped separator 85 (sometimes referred to as a flute, isolator or cross-web) or a tape separator and may be wound together with the separator 85 in a direction 89 to form a twisted core. The core twist direction 89 may be in the same direction as the pair twist directions of the first through fourth twisted pairs 61, 63, 65 and 67, however this is not a necessary feature. Other sizes and shapes of separators 85 may be employed in combination with the present invention, such as a generally flat tape (which separates two twisted pairs from the other two twisted pairs). The separator 85 may be formed of any solid or foamed material common to the cabling art, such as a polyolefin or fluoropolymer, like fluorinated ethylene propylene (FEP) or polyvinylchloride (PVC).

Figure 5:
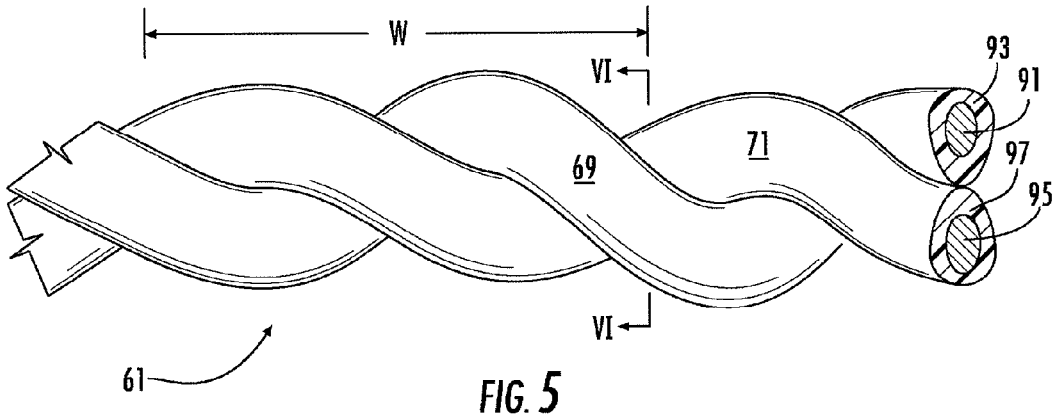
FIG. 5 is a close-up, side view of a first twisted pair of the cable in FIG. 4.

FIG. 5 is a close-up view of the first twisted pair 61. FIG. 6 is a cross sectional view taken along line VI-VI in FIG. 5. FIGS. 5 and 6 illustrate that the first insulated conductor 69 would be formed by a first conductor 91 with a diameter D1 of about twenty-three gauge size (e.g. 23 mils), surrounded by a first insulating material 93. Likewise, the second insulated conductor 71 would be formed by a second conductor 95 with a diameter D2 of about twenty-three gauge size, surrounded by a second insulating material 97.

In the embodiment depicted in FIG. 6, the first insulating material 93 directly abuts a circumference of the first conductor 91 and the second insulating material 97 directly abuts a circumference of the second conductor 95. In other embodiments, an intermediate layer of insulation or conductive material could exist between the insulating material 93 or 97 and the respective conductor 91 or 95.

The first insulating material 93 has a first area with a first radial thickness T1 and a second area, located on an opposite side of the first conductor 91, with a second radial thickness T2. The second radial thickness T2 is less than the first radial thickness T1. The first area of the first insulating material 93 resides along a portion of the first insulated conductor 69 which is abutting the second insulated conductor 71.

The second insulating material 97 has a third area with a third radial thickness T3 and a fourth area, located on an opposite side of the second conductor 95, with a fourth radial thickness T4. The fourth radial thickness T4 is less than the third radial thickness T3. The third area of the second insulating material 97 resides along a portion of the second insulated conductor 71 which is abutting the first insulated conductor 69.

In the illustrated embodiment, the second radial thickness T2 is at least 25% less than the first radial thickness T1, and more preferably the second radial thickness T2 is at least 50% less than the first radial thickness. For example, the second radial thickness T2 may be about 7 mils or less, while the first radial thickness T1 is about 8 mils or greater. More preferably, the second radial thickness T2 may be about 6 mils or less, while the first radial thickness T1 is about 9 mils or greater. In one cable design the, the first radial thickness T1 is about 11 mils and the second radial thickness T2 is about 5 mils. The third and fourth radial thicknesses T3 and T4 of the second insulated conductor 71 may have dimensions which are within the same ranges and examples as provided above for the first and second radial thicknesses T1 and T2, respectively.

The outer circumference of the first insulating material 93 in the embodiment of FIGS. 4-7 is non-circular. A first edge 90 of the outer circumference of the first insulating material 93, extending from point A to point B, follows an arc of a circle with a center in the center of the circular first conductor 91, where the radius might be around 20 to 25 mils, such as about 22 or about 23 mils. The remaining second edge 92 of the outer circumference of the first insulating material 93, extending from point A to point B, follows an arc of a circle with a center at the touching point E between the first insulated conductor 69 and the second insulated conductor 71, where the radius might be around 35 mils to 45 mils, such as about 39 mils or 40 mils.

The outer circumference of the second insulating material 97 in the embodiment of FIGS. 4-7 is also non-circular. A third edge 94 of the outer circumference of the second insulating material 97, extending from point C to point D, follows an arc of a circle with a center in the center of the circular second conductor 95, where the radius might be around 20 to 25 mils, such as about 22 or about 23 mils. The remaining fourth edge 96 of the outer circumference of the second insulating material 97, extending from point C to point D, follows an arc of a circle with a center at the touching point E between the first insulated conductor 69 and the second insulated conductor 71, where the radius might be around 35 mils to 45 mils, such as about 39 mils or 40 mils.

In one embodiment of the present invention, the first diameter D1 of the first conductor 91 is about 23 mils and the second diameter D2 of the second conductor 95 is about 23 mils. In this embodiment of the present invention, the thickness of the first insulating material 93 (measured at the point E where the first insulated conductor 69 touches or abuts the second insulated conductor 71) is about 11 mils. Likewise in this embodiment, the thickness of the second insulating material 97 (measured at the point E where the first insulated conductor 69 touches or abuts the second insulated conductor 71) is about 11 mils. Therefore, the spacing S1 between the center of the first conductor 91 and the center of the second conductor 95 is about 45 mils.

Figure 3:
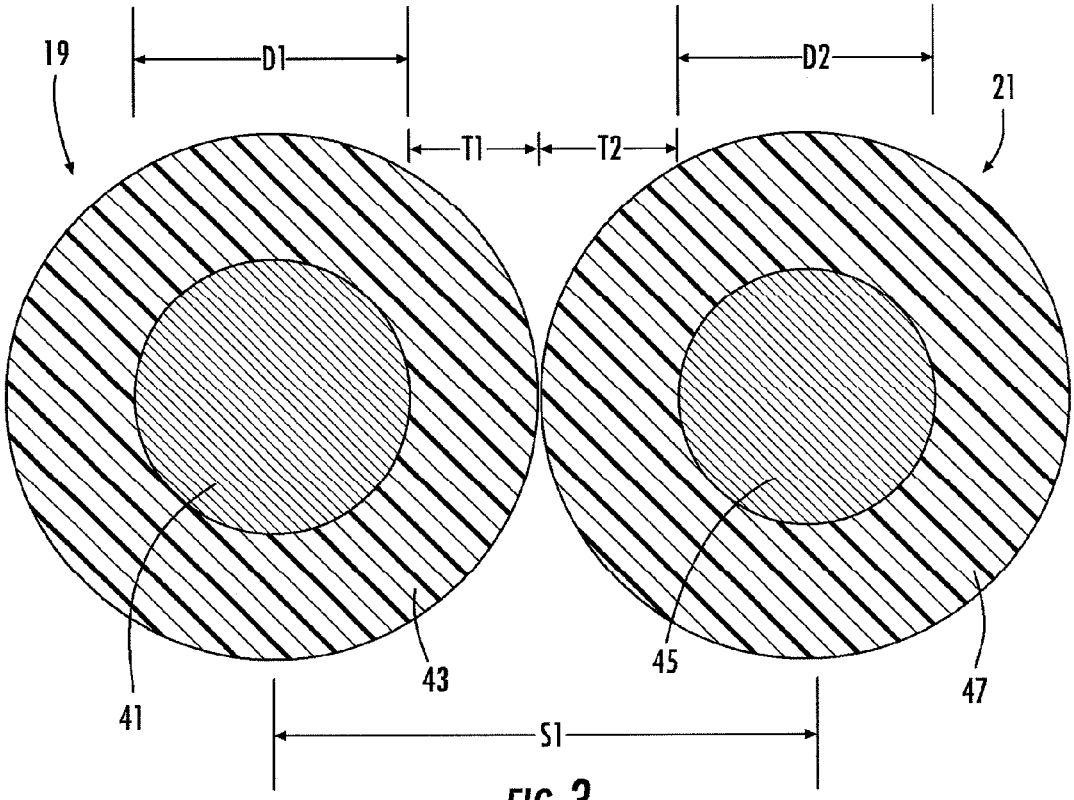
FIG. 3 (BACKGROUND ART)
FIG. 3 is a cross sectional view taken along line III-III in FIG. 2.

It should be noted that the spacing S1 in FIG. 6 is the same as the spacing S1 in FIG. 3, depicting the background art. The spacing S1 plays a large role in the impedance of the first twisted pair 61. Assuming that the material used to form the first and second conductors 91 and 95 (FIG. 6) is the same of the material used to form the first and second conductors 41 and 45 (FIG. 3) and the material used to form the first and second insulating materials 93 and 97 (FIG. 6) is the same as the material used to form the first and second insulating materials 43 and 47 (FIG. 3), the impedance will be substantially the same, e.g. around 100 Ohms.

Even though the impedance is approximately the same in comparing the first twisted pair 61 (FIGS. 5 and 6) to the first twisted pair 11 of the background art (FIGS. 2 and 3), the space occupied by the first twisted pair 61 of the present invention is remarkably less. For example, as the first twisted pair 11 of the background art is twisted within the cable 1, the first twisted pair 11 will occupy an area within a circle formed about the point where the first insulated conductor 19 abuts the second insulated conductor 21 with a radius of about 45 mils (where T1 equals 11 mils and D1 equal 23 mils). The area is determined by $\pi r^2$ and would equal $3.14(0.045\text{ in})^2$ or about $0.00636\text{ in}^2$.

In the exemplary embodiment of the present invention, as the first twisted pair 61 is twisted within the cable 51, the first twisted pair 61 will occupy an area within a circle formed about the center point E with a radius of about 39 mils (where T2 equals 5 mils, D1 equals 23 mils and T1 equals 11 mils). With the area determined by $\pi r^2$ this would equal $3.14(0.039\text{ in})^2$ or about $0.00478\text{ in}^2$. Hence the first twisted pair 61 would occupy a space within the cable 51 which is about 25% less than the space occupied by the first twisted pair 11 in the cable 1 of the background art.

Figure 7:
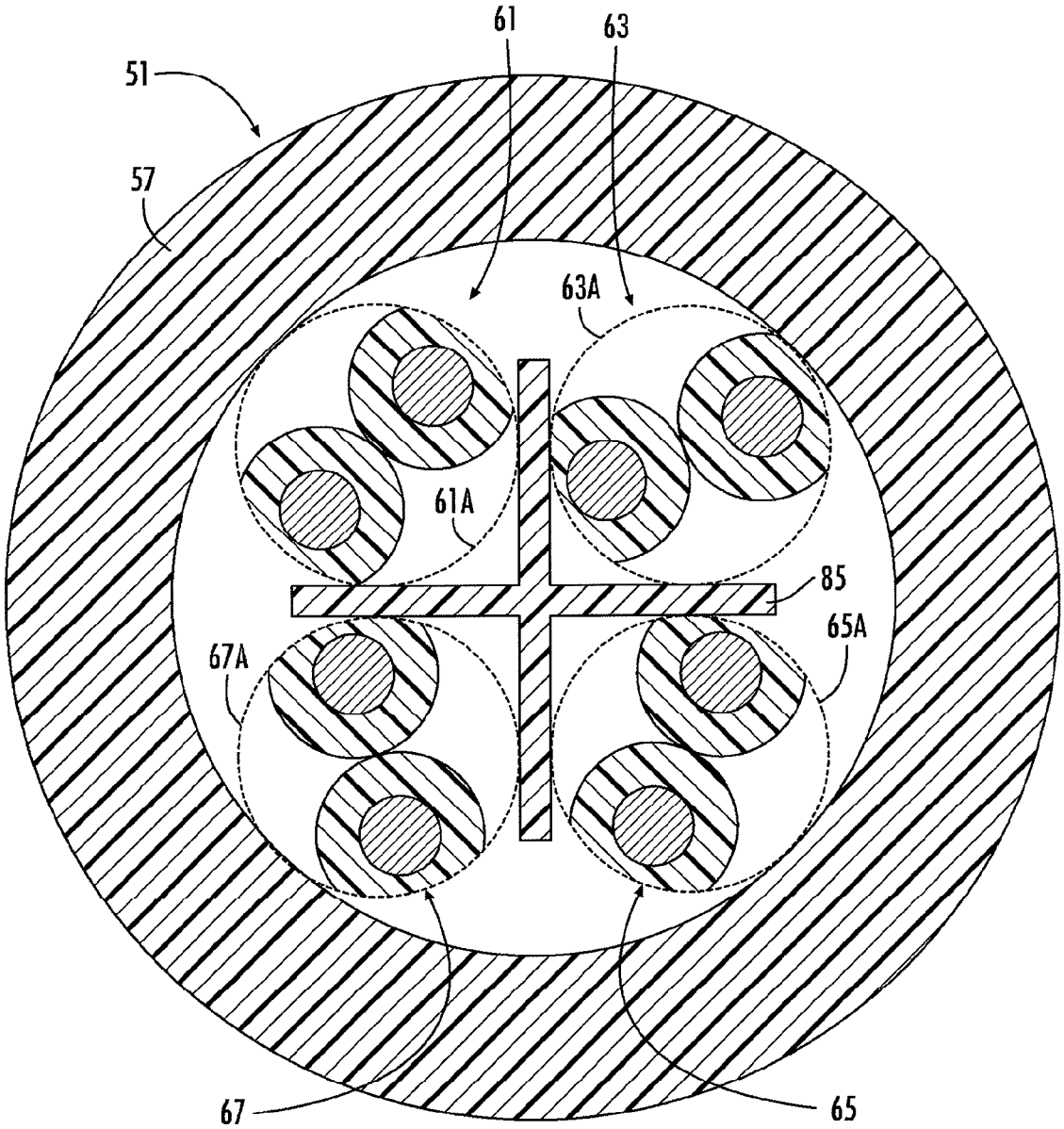
FIG. 7 is a cross sectional view taken along line VII-VII in FIG. 4.

As best seen in the cross sectional view of FIG. 7, the second, third and fourth twisted pairs 63, 65 and 67 of the cable 51 are constructed in a same or similar manner to the first twisted pair 61. In other words, the insulating layers of the third, fourth, fifth, sixth, seventh and eighth insulated conductors 73, 75, 77, 79, 81 and 83 would include an area with a first radial thickness and another area with a thinner second radial thickness.

FIG. 7 also illustrates the separator 85 with a cross-web design. The separator 85 legs are thin, having a thickness of about sixteen mils or less, more preferably thirteen mils or less, such as about ten mils. The separator 85 may be formed of any solid or foamed material common to the cabling art, such as a polyolefin or fluoropolymer, like fluorinated ethylene propylene (FEP) or polyvinylchloride (PVC). The separator may also take the form of a tape.

As seen in FIG. 7, the first twisted pair 61 twists within a circular area circumscribed by the dashed line 61A. The second twisted pair 63 twists within a circular area circumscribed by the dashed line 63A. The third twisted pair 65 twists within a circular area circumscribed by the dashed line 65A. The fourth twisted pair 67 twists within a circular area circumscribed by the dashed line 67A. Each of the first through fourth twisted pairs 61, 63, 65 and 67 occupies a reduced space within the jacket 57 of the cable 51, e.g., 25% less space than the twisted pairs 11, 13, 15 and 17 of the cable 1 of the background art. Hence, with all other factors remaining equal, the overall diameter of the cable 51 may be reduced, as compared to the cable 1 of the background art.

Moreover, the cable 51 of the present invention, as compared to the cable 1 of the background art on a per unit length basis, has less total material which can translate into a lower manufacturing cost, lower weight and less space requirements for storage, transportation and installation. Also, the reduction in overall material per unit length of cable can make the cable more flexible and can reduce the amount of smoke emitted in the case of a fire.

Figure 8:
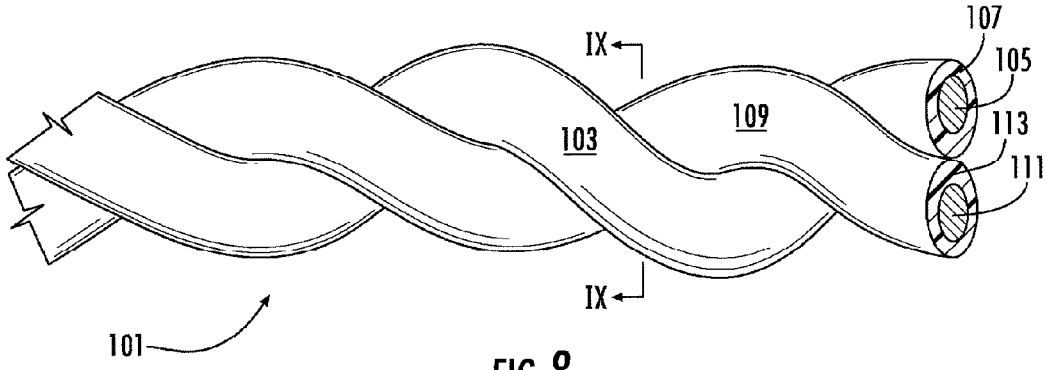
FIG. 8 is a close-up, side view of a twisted pair, in accordance with a second embodiment of the present invention.
Figure 9:
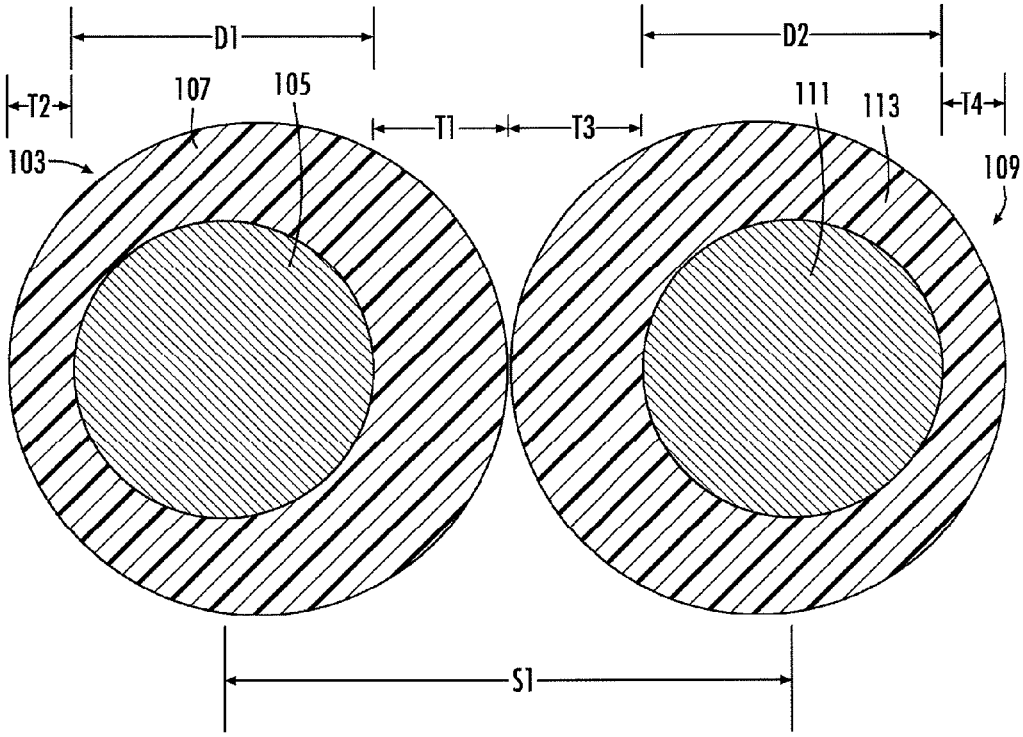
FIG. 9 is a cross sectional view taken along line IX-IX in FIG. 8.
Figure 10:
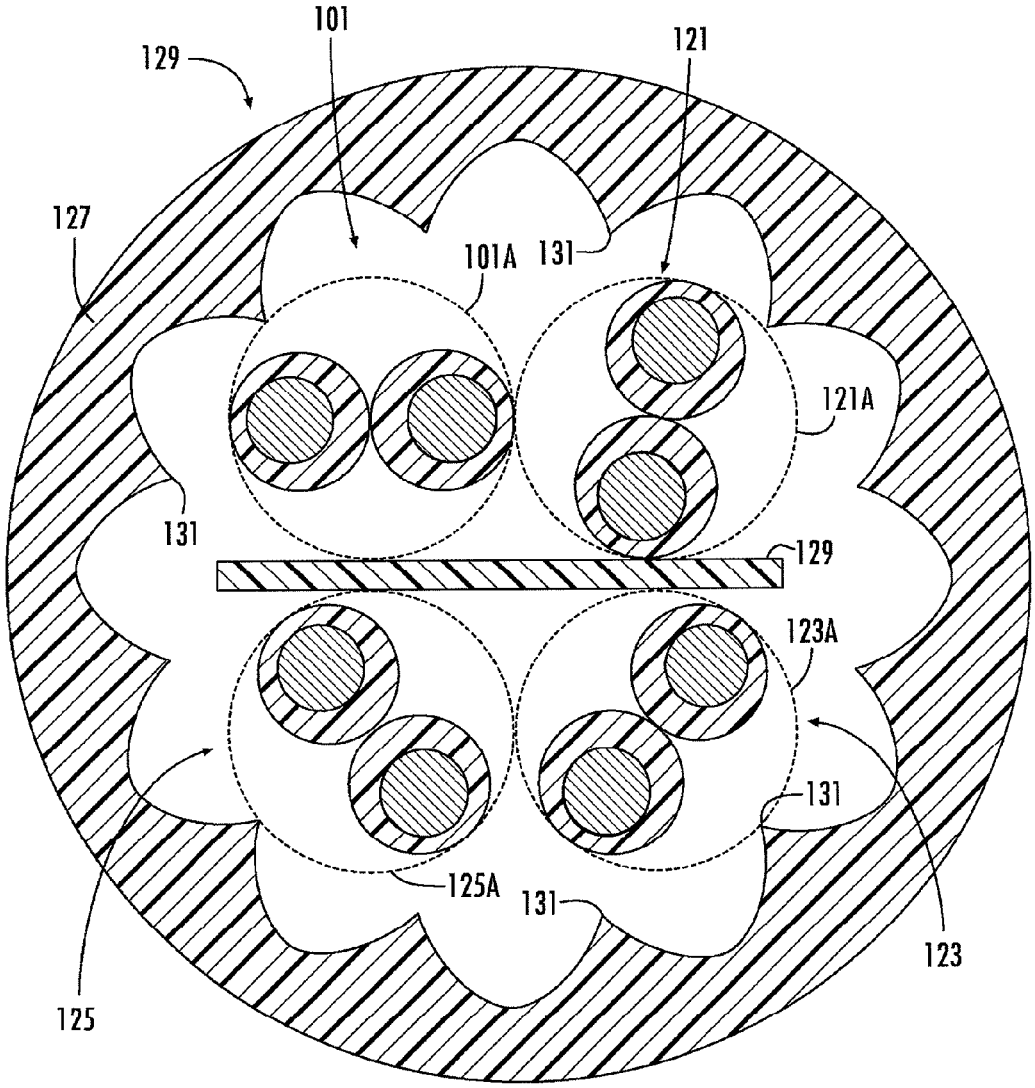
FIG. 10 is a cross sectional view similar to FIG. 7, but illustrating a twisted pair cable with four twisted pairs, constructed in accordance with FIGS. 8 and 9.

FIGS. 8-10 depict a second embodiment of the present invention. The second embodiment of the present invention shares the material savings attributes listed above in conjunction with the first embodiment. Moreover, the second embodiment of the present invention may be formed from the same material types as listed in describing the first embodiment of the present invention, however the overall shape of the first and second insulated conductors is different.

FIG. 8 is a close-up view of a first twisted pair 101. FIG. 9 is a cross sectional view taken along line IX-IX in FIG. 8. FIGS. 8 and 9 illustrate that a first insulated conductor 103 would be formed by a first conductor 105 with a diameter D1 of about twenty-three gauge size (e.g. 23 mils), surrounded by a first insulating material 107. Likewise, the second insulated conductor 109 would be formed by a second conductor 111 with a diameter D2 of about twenty-three gauge size, surrounded by a second insulating material 113.

In the embodiment depicted in FIGS. 8 and 9, the first insulating material 107 directly abuts a circumference of the first conductor 105 and the second insulating material 113 directly abuts a circumference of the second conductor 111. In other embodiments, an intermediate layer of insulation or conductive material could exist between the insulating material 107 or 113 and the respective conductor 105 or 111.

The first insulating material 107 has a first area with a first radial thickness T1 and a second area, located on an opposite side of the first conductor 105, with a second radial thickness T2. The second radial thickness T2 is less than the first radial thickness T1. The first area of the first insulating material 107 resides along a portion of the first insulated conductor 103 which is abutting the second insulated conductor 109.

The second insulating material 113 has a third area with a third radial thickness T3 and a fourth area, located on an opposite side of the second conductor 111, with a fourth radial thickness T4. The fourth radial thickness T4 is less than the third radial thickness T3. The third area of the second insulating material 113 resides along a portion of the second insulated conductor 109 which is abutting the first insulated conductor 103.

In the illustrated embodiment, the second radial thickness T2 is at least 25% less than the first radial thickness T1, and more preferably the second radial thickness T2 is at least 50% less than the first radial thickness. For example, the second radial thickness T2 may be about 7 mils or less, while the first radial thickness T1 is about 8 mils or greater. More preferably, the second radial thickness T2 may be about 6 mils or less, while the first radial thickness T1 is about 9 mils or greater. In one cable design the, the first radial thickness T1 is about 11 mils and the second radial thickness T2 is about 5 mils. The third and fourth radial thicknesses T3 and T4 of the second insulated conductor 109 may have dimensions which are within the same ranges and examples as provided above for the first and second radial thicknesses T1 and T2, respectively.

The outer circumference of the first insulating material 107 in the embodiment of FIGS. 8-10 is circular. For example, if D1 is about 23 mils, T1 is about 11 mils and T2 is about 5 mils, the radius length of the circular shape of the outer circumference of the first insulating material 107 would be about 19.5 mils and the overall diameter of the first insulated conductor 103 would be about 39 mils. The outer circumference of the second insulating material 113 in the embodiment of FIGS. 8-10 is also circular, and dimensioned the same as the first insulating material 107. In this embodiment of the present invention, the thickness of the first insulating material 107 (measured at the point where the first insulated conductor 103 touches or abuts the second insulated conductor 109) is about 11 mils. Likewise in this embodiment, the thickness of the second insulating material 113 (measured at the point where the first insulated conductor 103 touches or abuts the second insulated conductor 109) is about 11 mils. Therefore, the spacing S1 between the center of the first conductor 105 and the center of the second conductor 111 is about 45 mils.

It should be noted that the spacing S1 in FIG. 9 is about the same as the spacing S1 in FIG. 3, depicted the background art. Hence, the impedance of the first twisted pair 101 will be about 100 Ohms, as discussed in conjunction with the embodiment of FIGS. 4-7.

Even though the impedance is approximately the same in comparing the first twisted pair 101 (FIGS. 8 and 9) to the first twisted pair 11 of the background art (FIGS. 2 and 3), the space occupied by the first twisted pair 101 of the present invention is remarkably less. For example, as the first twisted pair 11 of the background art is twisted within the cable 1, the first twisted pair 11 will occupy an area about equal to 3.14 $(0.045\ \text{in})^2$ or about 0.00636 $\text{in}^2$, as shown above.

In the second embodiment of the present invention, as the first twisted pair 101 is twisted, the first twisted pair 101 will occupy an area within a circle formed about the center point where the first insulated conductor 103 abuts the second insulated conductor 109 with a radius of about 39 mils (where T2 equals 5 mils, D1 equals 23 mils and T1 equals 11 mils). With the area determined by $\pi r^2$, this would equal $3.14(0.039\ \text{in})^2$ or about 0.00478 $\text{in}^2$. Hence, again the first twisted pair. 101 would occupy a space which is about 25% less than the space occupied by the first twisted pair 11 in the cable 1 of the background art.

As best seen in the cross sectional view of FIG. 10, similarly configured second, third and fourth twisted pairs 121, 123 and 125 would be surrounded by a jacket 127 of a cable 129. FIG. 10 also illustrates the separator 129 with a tape design. The separator 129 is thin, having a thickness of about sixteen mils or less, more preferably thirteen mils or less, such as about ten mils. The separator 129 may be formed of any solid or foamed material common to the cabling art, such as a polyolefin or fluoropolymer, like fluorinated ethylene propylene (FEP) or polyvinylchloride (PVC). The separator may also take the form of a plus shaped isolator, crossweb or flute.

As seen in FIG. 10, the first twisted pair 101 twists within a circular area circumscribed by the dashed line 101A. The second twisted pair 121 twists within a circular area circumscribed by the dashed line 121A. The third twisted pair 123 twists within a circular area circumscribed by the dashed line 123A. The fourth twisted pair 125 twists within a circular area circumscribed by the dashed line 125A. Each of the first through fourth twisted pairs 101, 121, 123 and 125 occupies a reduced space within the jacket 127 of the cable 129, e.g., 25% less space than the first through fourth twisted pairs 11, 13, 15 and 17 of the cable 1 of the background art. Hence, with all other factors remaining equal, the overall diameter of the cable 129 may be reduced, as compared to the cable 1 of the background art. Further, all of the benefits ascribed to the cable 51 of FIG. 7 would also apply to the cable 129 of FIG. 10.

FIG. 10 also illustrates that the jacket 127 may include fins or projections 131 on an inner wall. The first through fourth twisted pairs 101, 121, 123 and 125 may contact inner ends of the projections 131. FIG. 10 shows twelve projections 131, however more or fewer projections may be included, with the goal being to hold the core of the twisted pairs 101, 121, 123 and 125 in the center of the cable 129 while creating air channels around the perimeter of the core of twisted pairs. The air channels along the inner wall of the jacket 127 increase certain electrical performance characteristics of the cable 129, such as reducing signal attenuation, and reducing alien crosstalk.

In the cables 51 and 129 of the present invention, different twist lengths w, x, y and z are applied to each of the first through fourth twisted pairs. The different twist lengths w, x, y and z benefit the electrical performance of the cables 51 and 129 by reducing internal crosstalk, between adjacent pairs within a same cable. However, employing different twist lengths also creates drawbacks, such as delay skew (e.g., it takes more time for a signal to travel to the far end of the cable on a relatively tighter twisted pair, as compared to a relatively longer twisted pair in the same cable). Differing twist lengths can also cause relative differences between the twisted pairs in such performance characteristics as attenuation and impedance.

In accordance with the present invention, the insulation layers of one or both of the insulated conductors forming a twisted pair may be different from any of the insulation layers of one, two or all three of the other twisted pairs in the cable. The difference could be in the employment of a different material with a different dielectric constant. More preferably, a same material is employed for all of the insulation layers, but air is introduced into the insulation layers to foam the insulation layers. Different degrees of foaming create different dielectric constants for the insulation layers. The foaming could be set at different levels for one or more of the twisted pairs, depending upon their twist length. For example, the insulation layers of the insulated conductors 69 and 71 in the tighter twisted pair 61 (in FIG. 4) could be foamed at a greater level than the insulation layers of the insulated conductors 77 and 79 in the longer twisted pair 65 (in FIG. 4), or no foaming could be employed in the insulation layers of the insulated conductors 77 and 79 in the longer twisted pair 65.

Although, the cables illustrated in the drawing figures have included four twisted pairs, it should be appreciated that the present invention is not limited to cables having only four twisted pairs. Cables having other numbers of twisted pairs, such as one twisted pair, two twisted pairs or even twenty-five twisted pairs, could benefit from the structures disclosed in the present invention.

Further, although the drawing figures have illustrated that the insulated conductors of each twisted pair within the cable have an insulation material with two different thickness areas, it would be possible for less than all of the twisted pairs to have the inventive insulation material thickness variance. For example, the first through third twisted pairs could include insulated conductors with insulation material having at least two different thicknesses, while the fourth twisted pair could have insulated conductors formed in the accordance with the background art (FIG. 3). Although the drawings have illustrated a 23 gauge conductor, the invention could be used with conductors of different sizes and insulation thicknesses.

Further, although the drawing figures have illustrated an unshielded cable, it is within the scope of the appended claims that the cable could include a shielding layer and/or a core wrap exterior to the cable core but interior to the outermost wall of the cable jacket. Further, although FIG. 7 illustrated a jacket 57 having a smooth inner wall, it is within the scope of the present invention that the inner wall of the jacket 57 could include fins or projections (as illustrated in FIG. 10) for creating air channels around the perimeter of the core of twisted pairs.

Figure 2:
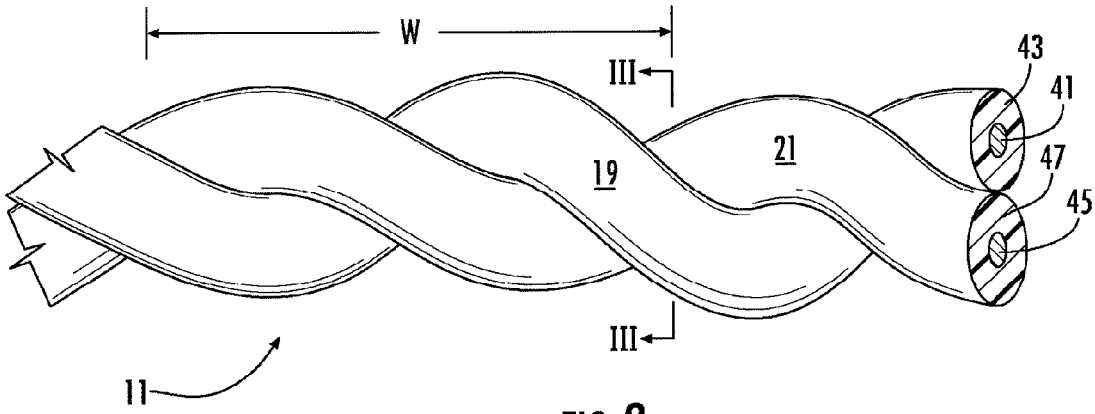
FIG. 2 (BACKGROUND ART)
FIG. 2 is a close-up, side view of a first twisted pair of the cable in FIG. 1.
Figure 11:
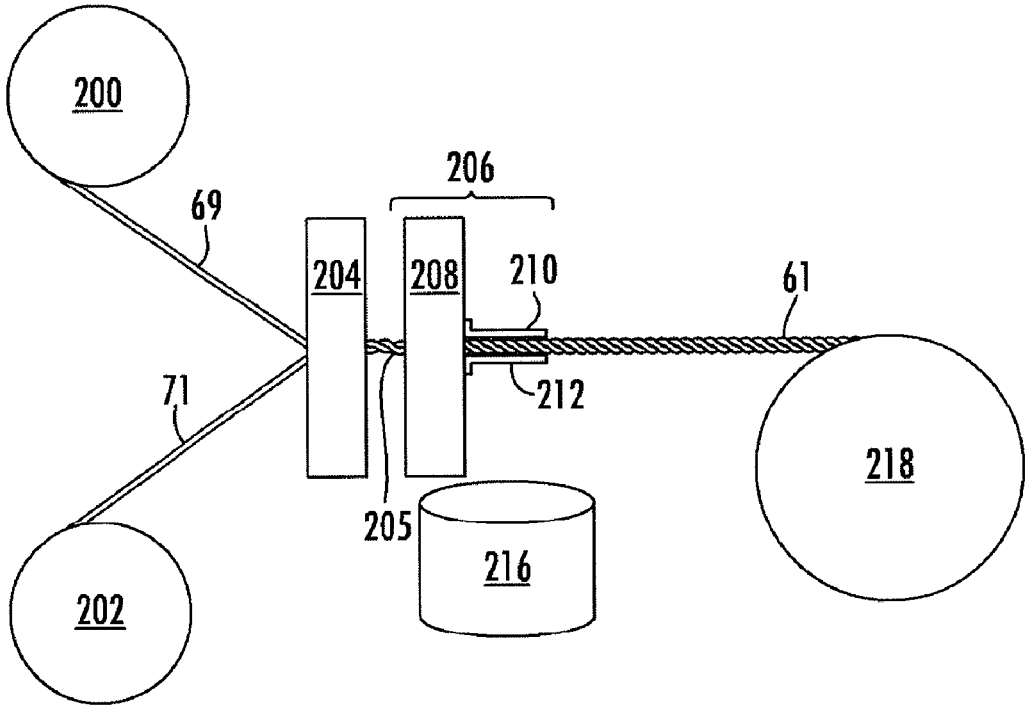
FIG. 11 is a block diagram illustrating one method of making the twisted pair of FIGS. 5-6.

Now, with reference to FIG. 11 one method of manufacturing the first twisted pair 61 of FIGS. 5-6 will be described. The first insulated conductor 69 is fed from a first spool 200 to a twinning machine 204. The second insulated conductor 71 is fed from a second spool 202 to the twist twinning machine 204. The twinning machine 204 is well known in the art and helically twists the first and second insulated conductors 69 and 71 to form a typical helically twisted pair 205 (as shown in FIGS. 2 and 3).

The helically twisted pair 205 is fed to a workstation 206. The workstation 206 includes a guide 208 having a rotating part 219 with an opening 220 closely resembling the outer profile of the typical helically twisted pair 105 (e.g., the profile depicted in FIG. 3). A first cutting instrument 210 is mounted to the rotating part 219 of the guide 208 near a top of the opening 220 and a second cutting instrument 212 is also mounted to the rotating part 219 of the guide 208 near a bottom of the opening 220. The first and second cutting instruments 210 and 212 shave off portions of the first and second insulating materials 93 and 97, respectively. The shavings are collected in a recycle bin 216. The shaved twisted pair 61 has the profile depicted in FIG. 6 and is then collected on a take-up spool 218.

Figure 12:
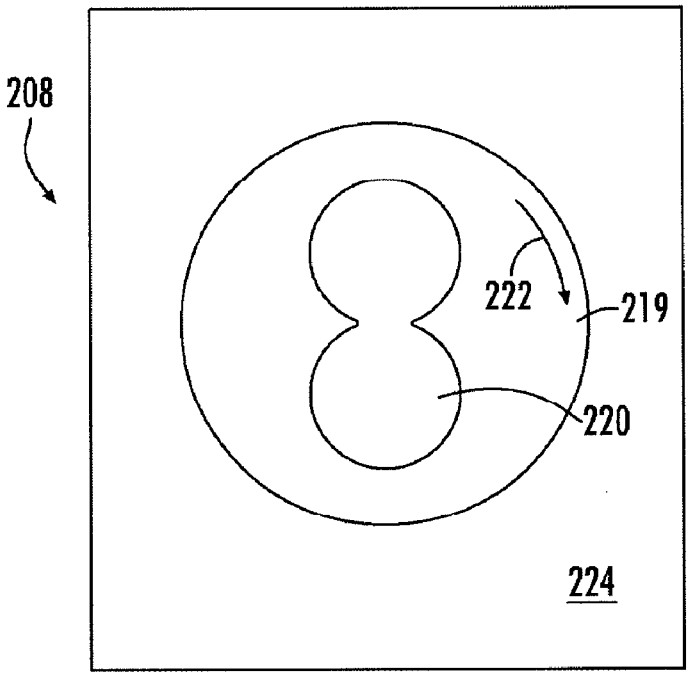
FIG. 12 illustrates a front face of a guide used in the method of FIG. 11.

FIG. 12 illustrates a front face of the guide 208, which would face toward the twist twinning machine 204. The rotating part 219 with the opening 220 may rotate clockwise in the direction of arrow 222 relative to a fixed base 224 of the guide 208. If the twist direction of the helically twisted pair 205 is counterclockwise, the rotating part 219 with the opening 220 may rotate counterclockwise opposite the arrow 222.

Figure 13:
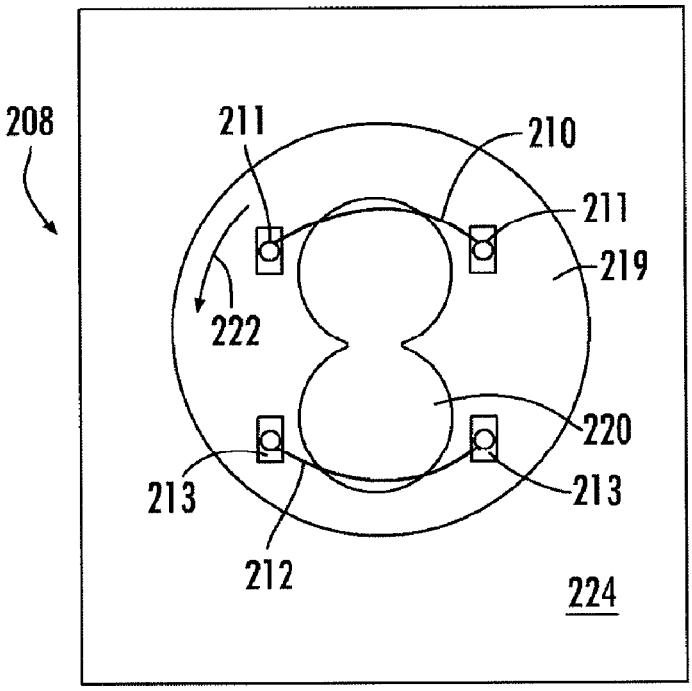
FIG. 13 illustrates a rear face of the guide of FIG. 12 and a cutting instrument attached to the rear face of the guide.

FIG. 13 illustrates a rear face of the guide 208, which would face toward the take-up spool 218. The first cutting instrument 210 is a curved blade which is attached to the rotating part 219 of the guide 208 by fixing devices, like screws 211. Likewise, the second cutting instrument 212 is a curved blade which is attached to the rotating part 219 of the guide 208 by fixing devices, like screws 213.

Figure 14:
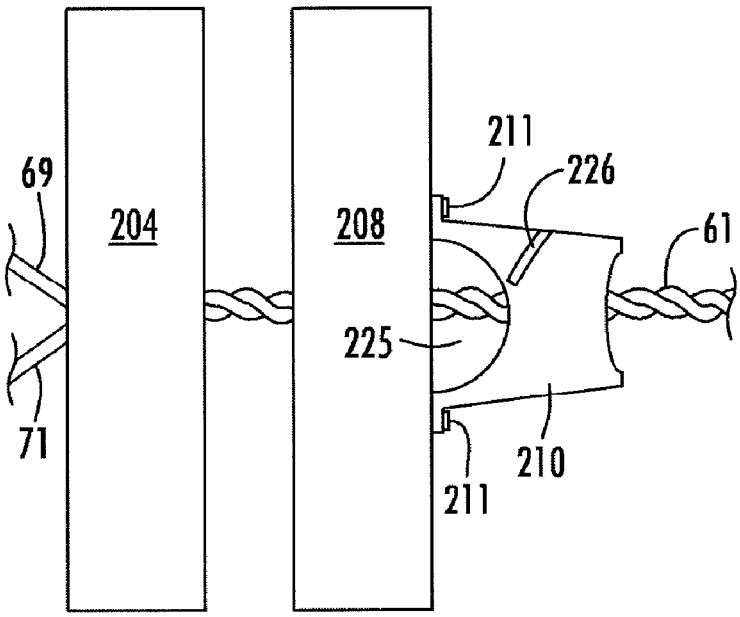
FIG. 14 is an overhead view of the guide and cutting instrument of FIG. 13.

FIG. 14 an overhead view of the guide 208. The overhead view illustrates a space 225 which exists between the first and second cutting instruments 210 and 212 to permit the shavings 226 to fallout to the recycle bin 216. Although the first and second cutting instruments 210 and 212 have been illustrated as blades, other types of cutting instruments, like a heated wire or laser may be employed.

Although FIGS. 11-14 have illustrate one method of shaving insulating material off of a twisted pair to form the first twisted pair 61 of FIGS. 5 and 6, it would also be possible to extrude the first and second insulating layers 93 and 97 of the first and second insulated conductors 69 and 71 in the shapes as shown in the cross sectional view of FIG. 6. The Extrusion die could be designed to form the desired insulation layer outer profile. Moreover, the first twisted pair 101 of FIGS. 8 and 9 could be formed by an extrusion process wherein the extrusion die is circular (as is common), but the conductor 105 or 111 is fed into the extrusion die in an offset manner so that the conductor is off center in the final insulated conductor 103 or 109, respectively.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

We claim:

1. A cable comprising:

a first conductor;

a first insulating material surrounding said first conductor to form a first insulated conductor;

a second conductor; and a second insulating material surrounding said second conductor to form a second insulated conductor, wherein said first and second insulated conductors are twisted about each other to form a twisted pair, wherein said first insulating material has a first area with a first radial thickness and a second area with a second radial thickness, wherein said second radial thickness is less than said first radial thickness, wherein said first area resides along a portion of said first insulated conductor which is abutting said second insulated conductor, and wherein a first edge of an outer circumference of said first insulating material extending from a first point to a second point includes said first area and follows an arc of a first circle with a first center, and wherein at least a portion of a remaining edge of said outer circumference of said first insulating material follows an arc of a second circle with a second center, different from said first center.

2. The cable of claim 1, wherein said second insulating material has a third area with a third radial thickness and a fourth area with a fourth radial thickness, wherein said fourth radial thickness is less than said third radial thickness, and wherein said third area resides along a portion of said second insulated conductor which is abutting said first insulated conductor.

3. The cable of claim 1, wherein said second radial thickness is at least 25% less than said first radial thickness.

4. The cable of claim 1, wherein said second radial thickness is at least 50% less than said first radial thickness.

5. The cable of claim 1, wherein said second radial thickness is about 7 mils or less and wherein said first radial thickness is about 8 mils or greater.

6. The cable of claim 1, wherein said second radial thickness is about 6 mils or less and wherein said first radial thickness is about 9 mils or greater.

7. The cable of claim 1, wherein said twisted pair is a first twisted pair, and further comprising:

second, third and fourth twisted pairs; and a jacket having inwardly extending projections on an inner wall surrounding said first, second, third and fourth twisted pairs.

8. The cable of claim 7, further comprising:

a separator within said jacket separating said first twisted pair from at least one of said second, third and fourth twisted pairs.

9. The cable of claim 1, wherein said first center is located at a center of said first conductor.

10. The cable of claim 1, wherein said second center is located at a touching point between said first insulated conductor and said second insulated conductor.

11. The cable of claim 1, wherein the entirety of said remaining edge of said outer circumference of said first insulating material follows the arc of the second circle.

12. The cable of claim 11, wherein said second center is located at a touching point between said first insulated conductor and said second insulated conductor.

13. A cable comprising:

a first conductor;

a first insulating material surrounding said first conductor to form a first insulated conductor;

a second conductor; and a second insulating material surrounding said second conductor to form a second insulated conductor, wherein said first and second insulated conductors are twisted about each other to form a twisted pair, wherein said first insulating material has a first area with a first radial thickness and a second area with a second radial thickness, wherein said second radial thickness is less than said first radial thickness, wherein said first area resides along a portion of said first insulated conductor which is abutting said second insulated conductor, and wherein an outer circumference of said first insulating material is circular.

14. The cable of claim 13, wherein said second insulating material has a third area with a third radial thickness and a fourth area with a fourth radial thickness, and wherein said fourth radial thickness is less than said third radial thickness.

15. The cable of claim 14, wherein said third area resides along a portion of said second insulated conductor which is abutting said first insulated conductor.

16. The cable of claim 15, wherein said first insulating layer directly abuts a circumference of said first conductor, and wherein said second insulating layer directly abuts a circumference of said second conductor.

17. The cable of claim 13, wherein said second radial thickness is at least 25% less than said first radial thickness.

18. The cable of claim 13, wherein said second radial thickness is about 7 mils or less and wherein said first radial thickness is about 8 mils or greater.

19. The cable of claim 13, wherein said twisted pair is a first twisted pair, and further comprising:

second, third and fourth twisted pairs; and a jacket having inwardly extending projections on an inner wall surrounding said first, second, third and fourth twisted pairs.

20. The cable of claim 19, further comprising:

a separator within said jacket separating said first twisted pair from at least one of said second, third and fourth twisted pairs.

* * * * *